US009032973B2

(12) United States Patent
Park

(10) Patent No.: US 9,032,973 B2
(45) Date of Patent: May 19, 2015

(54) HAIR CLIP

(71) Applicant: Hak Park, Gyeonggi-do (KR)

(72) Inventor: Hak Park, Gyeonggi-do (KR)

( * ) Notice: Subject to any disclaimer, the term of this patent is extended or adjusted under 35 U.S.C. 154(b) by 0 days.

(21) Appl. No.: 14/096,705

(22) Filed: Dec. 4, 2013

(65) Prior Publication Data

US 2015/0020842 A1 Jan. 22, 2015

(30) Foreign Application Priority Data

Jul. 18, 2013 (KR) ..... 20-2013-0005995
Sep. 27, 2013 (KR) ..... 20-2013-0008003

(51) Int. Cl.

| | |
|---|---|
| ***A45D 8/20*** | (2006.01) |
| ***A45D 8/22*** | (2006.01) |
| ***A45D 8/28*** | (2006.01) |
| ***A45D 8/24*** | (2006.01) |

(52) U.S. Cl.
CPC ... *A45D 8/24* (2013.01); *A45D 8/20* (2013.01)

(58) Field of Classification Search
CPC ..... A45D 8/00; A45D 8/10; A45D 8/14; A45D 8/16; A45D 8/20; A45D 8/24; A45D 8/26; A45D 8/28; A45D 8/30; A45D 8/32; A45D 8/34; A45D 8/36; A45D 8/22
USPC ..... 132/279, 212, 106, 107, 127, 128, 132/129–142, 144–146, 270, 273, 275–278, 132/109, 161, 901; 24/489, 543, 487, 510, 24/498, 499, 495, 547, 507; D28/32–34, D28/39–43
See application file for complete search history.

(56) References Cited

U.S. PATENT DOCUMENTS

| | | | | | |
|---|---|---|---|---|---|
| 2,833,292 | A | * | 5/1958 | Wirsing | 132/277 |
| 3,805,813 | A | * | 4/1974 | Laughton | 132/279 |
| 3,841,340 | A | * | 10/1974 | Solomon | 132/279 |
| 5,284,167 | A | * | 2/1994 | Gill | 132/200 |
| 5,355,899 | A | * | 10/1994 | Kuo-Hua | 132/279 |
| 5,365,955 | A | * | 11/1994 | Desgroux et al. | 132/279 |
| 5,605,166 | A | * | 2/1997 | Chou | 132/279 |
| 5,862,814 | A | * | 1/1999 | Janik et al. | 132/275 |
| 5,894,850 | A | * | 4/1999 | Kimura | 132/279 |

(Continued)

FOREIGN PATENT DOCUMENTS

| | | | |
|---|---|---|---|
| JP | 07-023814 | A | 1/1995 |
| JP | 2008-055069 | A | 3/2008 |

(Continued)

OTHER PUBLICATIONS

Japanese Office Action with translation dated Dec. 15, 2014.

*Primary Examiner* — Vanitha Elgart
(74) *Attorney, Agent, or Firm* — Rabin & Berdo, P.C.

(57) ABSTRACT

Disclosed is a hair clip that can effectively and firmly hold hair, without having to use additional hair clips. The hair clip includes an upper hair clip portion with a first end provided with a first pressed portion, a middle clip portion with a first end connected to a second end of the upper clip portion, and a lower clip portion with a first end which is hinge-connected to the first end of the upper clip portion and which is provided with a second pressed portion, the lower clip portion supporting the middle clip portion. The upper clip portion and the middle clip portions are hinge-connected to each other. The upper clip portion and the lower clip portion are hinge-connected to each other. The upper clip portion has a first toothed portion having teeth protruding toward the lower clip portion.

6 Claims, 12 Drawing Sheets

(56) References Cited

U.S. PATENT DOCUMENTS

| | | | | |
|---|---|---|---|---|
| 5,896,865 | A * | 4/1999 | Patel | 132/277 |
| 6,098,636 | A * | 8/2000 | Curtiss et al. | 132/277 |
| 6,142,158 | A * | 11/2000 | Lloyd et al. | 132/275 |
| 6,192,894 | B1 * | 2/2001 | Yasuda | 132/277 |
| 6,311,700 | B1 * | 11/2001 | Yeh | 132/279 |
| 6,378,532 | B1 * | 4/2002 | Chou et al. | 132/279 |
| 6,494,214 | B1 * | 12/2002 | Coldicott | 132/213.1 |
| 6,536,446 | B2 * | 3/2003 | Kimura | 132/277 |
| 6,591,843 | B1 * | 7/2003 | Langohr | 132/277 |
| D493,572 | S * | 7/2004 | Stachowski | D28/42 |
| 7,540,290 | B2 * | 6/2009 | Chou | 132/278 |
| 7,631,648 | B2 * | 12/2009 | Kirby | 132/276 |
| 7,735,497 | B2 * | 6/2010 | Kim | 132/276 |
| 7,766,020 | B2 * | 8/2010 | Chininis et al. | 132/278 |
| 8,061,369 | B2 * | 11/2011 | Kim | 132/277 |
| 2006/0037626 | A1 * | 2/2006 | Lane | 132/277 |
| 2006/0096609 | A1 * | 5/2006 | Nwokola | 132/201 |
| 2009/0229626 | A1 * | 9/2009 | Hsu | 132/277 |
| 2011/0023905 | A1 * | 2/2011 | Choi | 132/277 |
| 2011/0041867 | A1 * | 2/2011 | Hsu | 132/276 |
| 2012/0048292 | A1 * | 3/2012 | Tokko | 132/277 |
| 2013/0233337 | A1 * | 9/2013 | Carey | 132/277 |
| 2014/0060570 | A1 * | 3/2014 | Tsai | 132/277 |

FOREIGN PATENT DOCUMENTS

| | | | |
|---|---|---|---|
| JP | 2009-082690 | A | 4/2009 |
| KR | 10-0764540 | B1 | 10/2007 |

* cited by examiner

HAIR CLIP

BACKGROUND OF THE INVENTION

1. Field of the Invention

The present invention relates to a hair clip.

2. Description of the Related Art

Generally, a hair clip is used to pinch hair when cutting or dying hair or performing other treatments on hair in homes or beauty shops.

FIGS. 11 and 12 illustrate some examples of a hair clip. FIG. 11 is a perspective view of a hair clip and FIG. 12 illustrates the hair clip of FIG. 11 pinching hair.

A conventional hair clip includes an upper clip portion 100 and a lower clip portion 200. The upper clip portion 100 and the lower clip portion 200 are hinge-connected to each other so that free ends of the upper clip portion 100 and the lower clip portion 200 come into contact with each other by elastic force, pinching hair therebetween. Specifically, a hinge mechanism for connecting the upper clip portion 100 and the lower clip portion 200 includes a hinge pin 300 which passes through an end 101 of the upper clip portion 100 and an end 201 of the lower clip portion 200, and a coil spring 400 which is installed to wind around the hinge pin.

When a conventional hair clip is used to pinch hair, the ends 102 and 202 of the upper clip portion 100 and the lower clip portion 200 separate from each other. As the distance to the remaining ends 102 and 202 of the upper clip portion 100 and the lower clip portion 200 is decreased, the force of pinching hair is decreased. This makes the hair clip difficult to pinch hair.

For this reason, while hair is being treated, such as trimming or dying, part of the hair slips out of the hair clip, passing the remaining ends of the hair clip. This may cause inconvenience to a user, so the user may have to use more than one hair clip.

The foregoing is intended merely to aid in the understanding of the background of the present invention, and is not intended to mean that the present invention falls within the purview of the related art that is already known to those skilled in the art.

SUMMARY OF THE INVENTION

Accordingly, the present invention has been made keeping in mind the above problems occurring in the related art, and the present invention is intended to provide a hair clip which firmly and effectively pinches hair without requiring a user to use additional hair clips.

The present invention not only has the objects which are explicitly stated above but also other objects that can be achieved by the following embodiments described below.

According to one aspect of the present invention, there is provided a hair clip including: an upper clip portion having a first end provided with a first pressed portion; a middle clip portion having a first end hinge-connected to a second end of the upper clip portion; and a lower clip portion having a first end hinge-connected to the first end of the upper clip portion, being provided with a second pressed portion which is pressed together with the first pressed portion, and supporting the middle clip portion, wherein the upper clip portion and the middle clip portion are hinge-connected to each other so that elastic force acts in a direction in which the upper clip portion and the middle clip portion separate from each other, the upper clip portion and the lower clip portion are hinge-connected to each other so that elastic force acts in a direction in which the upper clip portion and the lower clip portion approach each other, and the upper clip portion has a first toothed portion having teeth protruding toward the lower clip portion.

The first toothed portion may be formed between a hinge-connected portion and a middle portion of the upper clip portion in a longitudinal direction.

The middle clip portion may be provided with a second toothed portion having teeth protruding toward the lower clip portion.

A length of the teeth of the second toothed portion may be increased as a distance to the first end of the middle clip portion in the longitudinal direction is decreased.

A width of the lower clip portion may be decreased as a distance to the second end of the lower clip portion is decreased.

The first end of the middle clip portion may be provided with an accommodation recess in which the second end of the lower clip portion is accommodated while the hair clip is pinching hair.

According to another aspect of the present invention, there is provided a hair clip including: an upper clip portion which has a first end provided with a first pressed portion and which has a first through hole extending in a longitudinal direction, a middle clip portion having a first end hinge-connected to a second end of the upper clip portion and a second end inserted into the first through hole when the hair clip pinches hair, and a lower clip portion which is provided with a second pressed portion, has a first end hinge-connected to the first end of the upper clip portion, and supports the middle clip portion, wherein the upper clip portion and the middle clip portion are hinge-connected to each other so that elastic force acts in a direction in which the upper clip portion and the middle clip portion separate from each other, and the upper clip portion and the lower clip portion are hinge-connected to each other so that elastic force acts in a direction in which the upper clip portion and the lower clip portion approach each other.

The middle clip portion may have a toothed protrusion at a lower end thereof.

The lower clip portion may be provided with a second through hole through which the first end of the middle clip portion passes when the hair clip holds hair.

When pressing force is applied to the hair pin in a direction in which the first pressed portion and the second pressed portion approach each other, a second end of the middle clip portion slides toward a leading end of the hair clip while the second end of the middle clip portion is in contact with the upper clip portion. So hair may not come into contact with a hinge mechanism for connecting the upper clip portion and the lower clip portion.

A pair of rails in parallel with each other may be formed on an upper surface of the lower clip portion, and the toothed protrusion of the middle clip portion may be located between the pair of rails.

The hinge mechanism for connecting the upper clip portion and the lower clip portion may include a hinge pin which passes through the first end of the upper clip portion and the first end of the lower clip portion, and a coil spring which is installed to wind around the hinge pin.

A hinge mechanism for connecting the upper clip portion and the middle clip portion may include a hinge pin which passes through the second end of the upper clip portion and the first end of the middle clip portion, and a coil spring which is installed to wind around the hinge pin.

The lower clip portion may have a support sill near the second through hole in order to support the middle clip portion.

As described above, the hair clip according to the present invention has the following advantages.

Since the middle clip portion is hinge-connected to the upper clip portion so that elastic force acts in a direction in which the middle clip portion and the upper clip portion separate from each other, the middle clip portion opens in the direction of the strands of hair and thus effectively pinches the hair.

Since the upper clip portion is provided with the first toothed portion having teeth protruding toward the lower clip portion, hair can be more firmly pinched by the first toothed portion. When the first toothed portion is formed between a middle portion of the upper clip portion in a longitudinal direction and the hinge mechanism, the hair between the middle portion of the upper clip portion and the hinge-connected portion can be more firmly pinched by the first toothed portion.

Since the middle clip portion is provided with the second toothed portion having teeth protruding toward the lower clip portion, hair can be firmly held by the second toothed portion. When the length of the teeth of the second toothed portion is increased as the distance to the first end of the middle clip portion is decreased, hair cannot escape from the hair clip, passing the first end of the middle clip portion.

Since the first end of the middle clip portion is provided with the accommodation recess in which the second end of the lower clip portion is accommodated, the second end of the lower clip portion is inserted into the accommodation recess of the middle clip portion when the hair clip pinches hair, and thus hair cannot escape from the hair clip but is firmly pinched.

Since the first end of the middle clip portion is inserted into the second through hole of the lower clip portion, hair cannot escape from the hair clip but is firmly pinched.

Since whether the second end of the middle clip portion passes through the first through hole is determined according to the volume of hair which is pinched, and the middle clip portion and the upper clip portion are hinge-connected to each other so that elastic force acts in a direction in which the middle clip portion and the upper clip portion separate from each other, the middle clip portion opens in a direction of hair and thus effectively pinches the hair.

Furthermore, thanks to the mutual action between the toothed protrusion of the middle clip portion and the rails of the lower clip portions, hair can be firmly pinched.

Since the second end of the middle clip portion slides toward the leading end of the hair clip while the second end of the middle clip portion is being in contact with the upper surface of the lower clip portion, this sliding prevents hair from coming into contact with and entering into the hinge mechanism for connecting the upper clip portion and the lower clip portion.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF THE INVENTION

Hereinafter, the present invention will be described in detail with reference to the accompanying drawings.

[First Embodiment]

Figure 1:
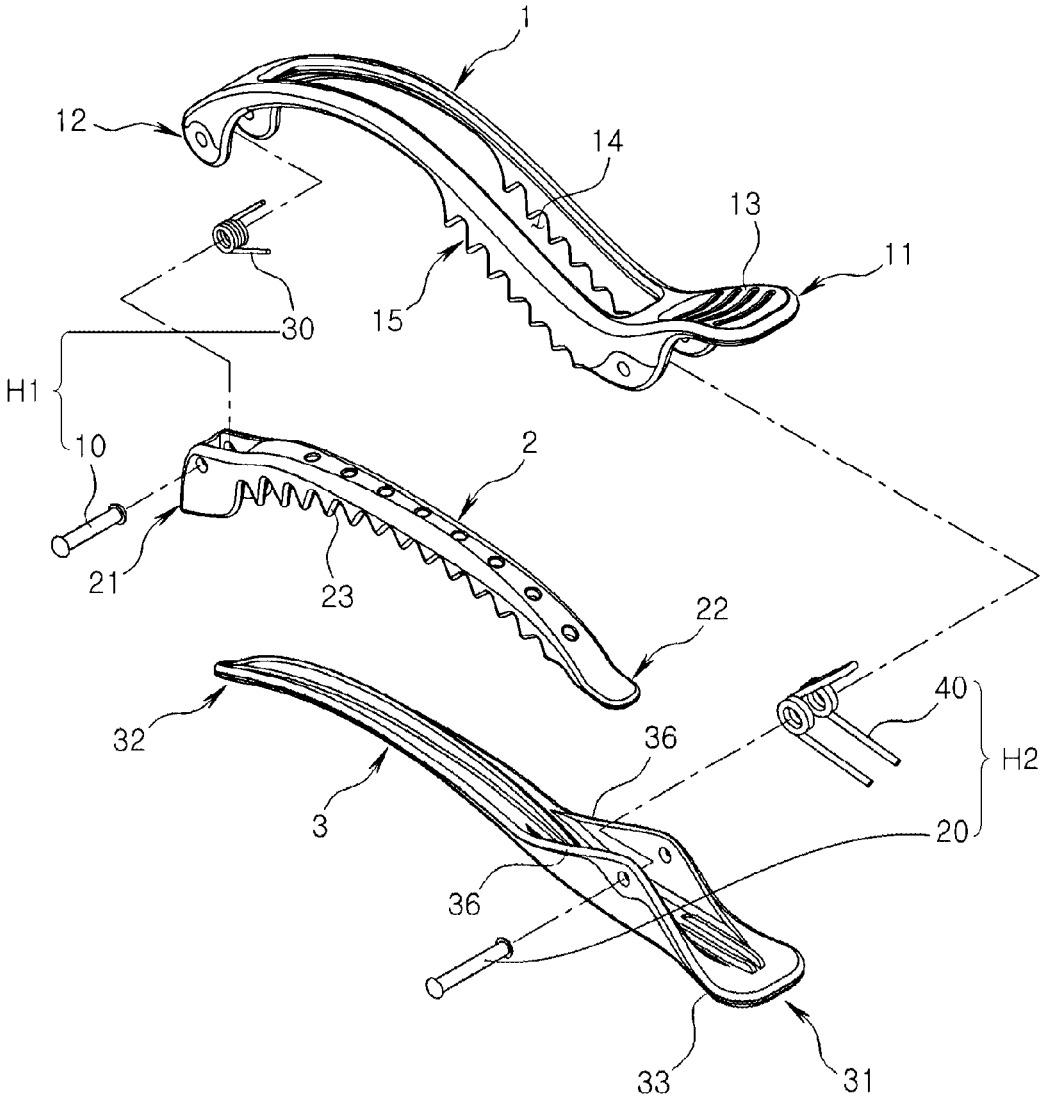
FIG. 1 is an exploded perspective view illustrating a hair clip according to a first embodiment of the present invention.
Figure 2:
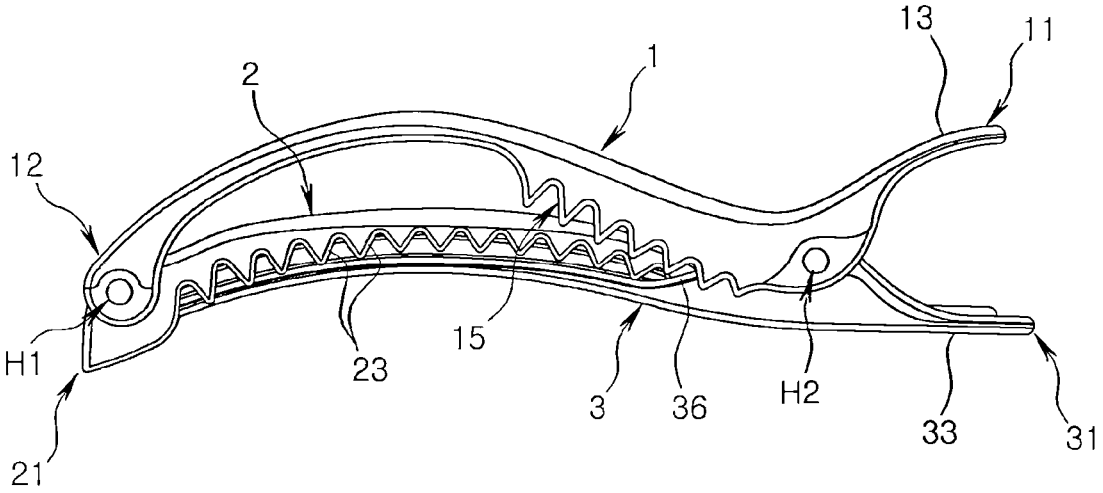
FIG. 2 is a front view illustrating a state where the hair clip of FIG. 1 is assembled and then pressed.

First, a hair clip (hereinafter, referred to as "present hair clip") according to a first embodiment will be described with reference to FIGS. 1 to 5. FIG. 1 is an exploded perspective view illustrating a main portion of the present hair clip and FIG. 2 is a front view which illustrates a state where the hair clip of FIG. 1 is assembled.

As illustrated in FIG. 1, the present hair clip includes an upper clip portion 1, a middle clip portion 2, and a lower clip portion 3.

A first end 11 of the upper clip portion 1 is provided with a first pressed portion 13 which is pinched and pressed by user's fingers. The upper clip portion 1 has a first through hole 14 which extends in a longitudinal direction. Referring to FIG. 1, the upper clip portion 1 has a sectional shape of the letter "S". That is, the upper clip portion 1 has a curved shape to hold a large volume of hair.

The upper clip portion 1 has a first toothed portion 15 which protrudes toward the lower clip portion 3. Thanks to the first toothed portion 15, hair can be more firmly fixed to the head by the hair clip. Especially, in the upper clip portion 1, when the first toothed portion 15 is formed between a middle portion in the longitudinal direction of the upper clip portion 1 and a second hinge mechanism (H2 in FIG. 2), the hair which enters between the middle portion of the upper clip portion 1 and the second hinge mechanism H2 can be securely pinched and fixed by the presence of the first toothed portion 15.

Figure 5:
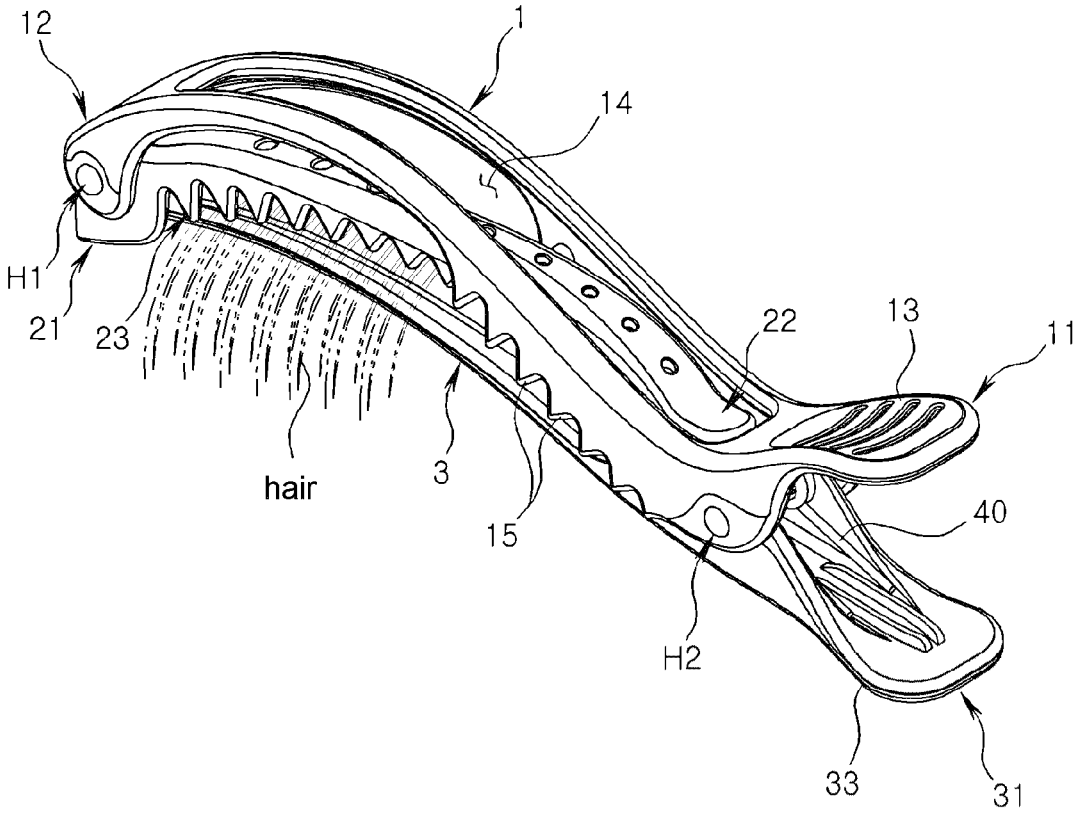
FIG. 5 is a perspective view illustrating a state where the hair clip of FIG. 2 is pinching hair.

In the middle clip portion 2, a first end 21 is connected to a second end 12 of the upper clip portion 1. When the hair clip pinches hair, especially, a large volume of hair, a second end 22 may pass through the first through hole 14 of the upper clip portion 1. Accordingly, a width of the second end 22 of the middle clip portion 2 is desirably smaller than a width of the first through hole 14 formed in the upper clip portion. With reference to FIG. 5, the second end 22 of the middle clip portion 2 is inserted in the first through hole 14 of the upper clip portion 1. The length of the second end portion 22 which is inserted in the first through hole 14 of the upper clip portion 1 varies depending on the volume of hair pinched by the hair clip.

The upper clip portion 1 and the middle clip portion 2 are connected by a first hinge mechanism H1 so that elastic force acts in a direction in which the upper clip portion 1 and the middle clip portion 2 separate from each other. Specifically, a first hinge mechanism H1 which connects the upper clip portion 1 and the middle clip portion 2 in a hinged manner includes a hinge pin 10 which passes through the second end 12 of the upper clip portion 1 and the first end 21 of the middle clip portion 2, and a coil spring 30 which is installed to wind around the hinge pin 10 so that elastic force acts in a direction in which the upper clip portion 1 and the middle clip portion separate from each other.

The middle clip portion 2 has a pair of second toothed portions 23 at a lower end thereof. The second toothed portions 23 in parallel with each other protrude toward the lower clip portion 3 from side edges of the lower end of the middle clip portion 2, and extend along the longitudinal direction. For reference, FIG. 1 illustrates only one second toothed portion 23 of the pair of second toothed portions 23. That is, the other second toothed portion 23 on the opposite side is not illustrated.

In each toothed portion 23, the closer to the first end 21 of the middle clip portion 2 in the longitudinal direction of the middle clip portion 2, the longer the teeth protrude. When the length of the teeth of the second toothed portion 23 is increased as the distance to the first end 21 is decreased, it is possible to prevent hair from slipping out of the hair clip via the first end 21.

The lower clip portion 3 is provided with a second pressed portion 33. The lower clip portion 3 has a first end 31 which is hinge-connected to the first end 11 of the upper clip portion 1. The lower clip portion 3 supports the middle clip portion 2. The first end 31 of the lower clip portion 3 is provided with a second pressed portion 33 which is pressed together with the first pressed portion 13.

The upper clip portion 1 and the lower clip portion 3 are connected by the second hinge mechanism H2 so that elastic force acts in a direction in which the upper clip portion 1 and the lower clip portion 3 approach each other, that is, a direction in which the leading end of the hair clip (A in FIG. 3) closes. For example, the second hinge mechanism H2 which connects the upper clip portion 1 and the lower clip portion 3 in a hinged manner includes a hinge pin 20 which passes through the first end 11 of the upper clip portion 1 and the first end 31 of the lower clip portion 3, and a coil spring 40 which is installed to wind around the hinge pin 20 so that elastic force acts in a direction in which the upper clip portion 1 and the lower clip portion approach each other.

Figure 4:
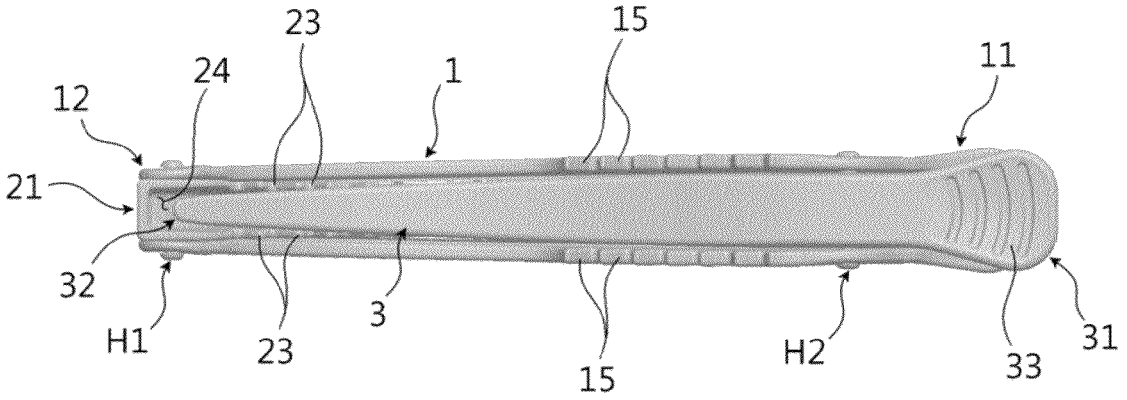
FIG. 4 is a bottom plan view illustrating the hair clip of FIG. 2.

As illustrated in FIGS. 1 and 4, the width of the lower clip portion 3 is decreased as the distance to the second end 32 of the lower clip portion 3 is decreased. Accordingly, the lower clip portion 3 can be made to be slimmer from the view point of design. With reference to FIG. 4, like the lower clip portion 3 described above, the first end of the middle clip portion 2 is provided with an accommodation recess 24 in which the second end of the lower clip portion 3 is accommodated while the hair clip is pinching hair. Since the first end 21 of the middle clip portion 2 is provided with the accommodation recess 24, the second end 32 of the lower clip portion 3 is inserted into the accommodation recess 24 of the middle clip portion 2 so that hair cannot escape from the hair clip and is firmly pinched.

The second end 22 of the lower clip portion 3 is a free end. When a user presses the hair clip such that the first pressed portion 13 and the second pressed portion 33 approach each other, the second end 22 of the middle clip portion 2 slides toward the leading end A of the hair clip while the second end 22 of the middle clip portion 2 is in contact with an upper surface of the lower clip portion 3. Accordingly, it is possible to prevent hair from entering into the hinge mechanism H2 for connecting the upper clip portion 1 and the lower clip portion 3 in a hinged manner. In order to help the second end 22 of the middle clip portion 2 to slide, a guide wall 36 for guiding the second end 22 of the middle clip portion 2 is formed on the upper surface of the middle clip portion 3.

Next, operation of the hair clip according to one embodiment having the above-described structure is described.

Figure 3:
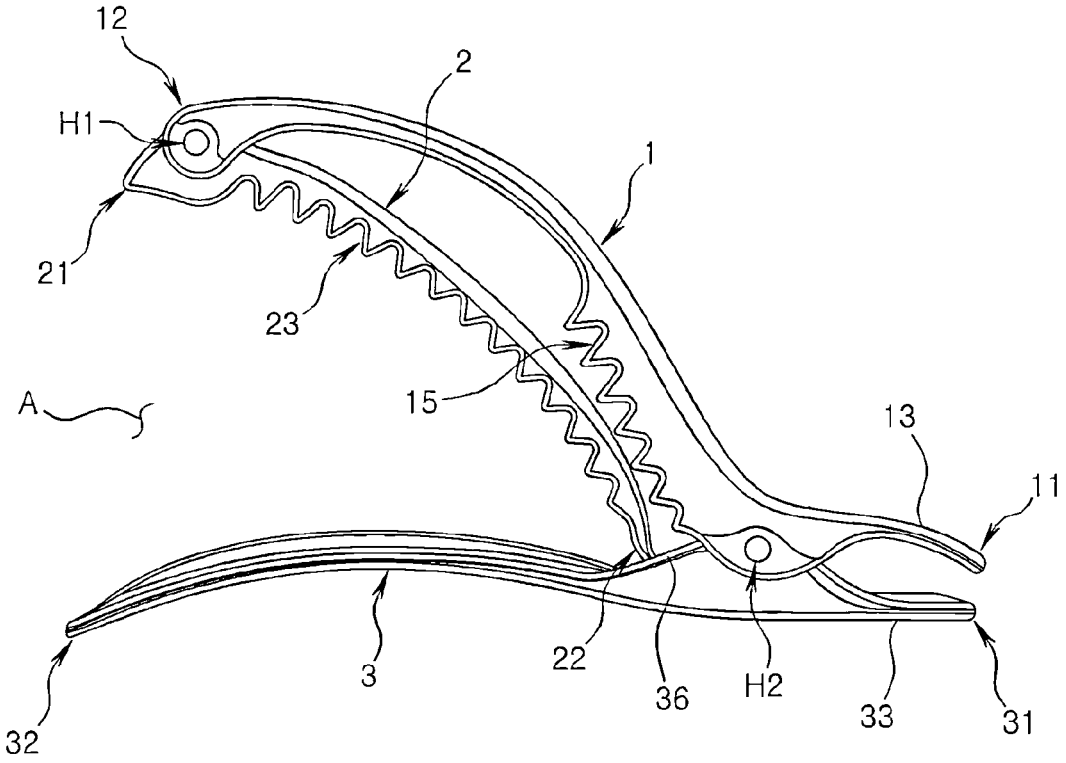
FIG. 3 is a front view illustrating a state where the hair clip of FIG. 2 is fully pressed.

For reference, FIG. 3 illustrates the hair clip fully pressed, FIG. 4 is a bottom view of the hair clip, and FIG. 5 illustrates the hair clip which is pinching hair after pressing force applied to the hair clip is removed.

As illustrated in FIG. 3, the user presses the first pressed portion 13 of the upper clip portion 1 and the second pressed portion 33 of the lower clip portion 3 so that the first pressed portion 13 and the second pressed portion 33 approach each other and the leading end A opens.

At this time, the middle clip portion 2 also moves so that the middle clip portion 2 separates from the upper clip portion 1, and the second end 22 of the middle clip portion 2 slides toward the leading end A of the hair clip while the second end 22 is in contact with the upper surface of the lower clip portion 3. This operation prevents hair from entering into the second hinge mechanism H2.

When pressing force applied to the first pressed portion 13 of the upper clip portion 1 and the second pressed portion 33 of the lower clip portion 3 is removed in a state where a predetermined volume of hair is inserted between the middle clip portion 2 and the lower clip portion 3, hair is pinched between the first toothed portion 15 of the upper clip portion 1 and the lower clip portion 3, and between the second toothed portion 23 of the middle clip portion 2 and the lower clip portion 3. Thanks to the first toothed portion 15 of the upper clip portion 1, hair between the middle portion of the upper clip portion 1 and the second hinge mechanism H2 is firmly pinched by the first toothed portion 15.

At this time, as illustrated in FIG. 4, the second end 32 of the lower clip portion 3 is inserted into the accommodation recess 24 formed at the first end 21 of the middle clip portion 2, so hair will not slip out of the hair clip but be firmly pinched.

The second end 22 of the middle clip portion 2 may or may not pass through the first through hole 14 of the upper clip portion 1 according to the volume of hair pinched. Furthermore, the middle clip portion 2 is hinge-connected to the upper clip portion 1 so that elastic force acts in a direction in which the middle clip portion 2 and the upper clip portion 1 separate from each other. For this reason, hair can be effectively pinched by the hair clip. In addition, hair is more firmly pinched by a mutual action between the second toothed portion 23 of the middle clip portion 2 and the lower clip portion 3. Since the length of the teeth of the second toothed portion 23 is increased as the distanced to the first end 21 of the middle clip portion 2 is decreased, it is possible to prevent hair from slipping out of the hair clip, passing the first end 21.

As described above, the hair clip according to the present invention can pinch a large volume of hair at a time, and can firmly pinch the hair so that the hair cannot escape from the hair clip thanks to the hinge mechanism which connects the upper clip portion and the middle clip portion and the hinge mechanism which connects the upper clip portion and the lower clip portion.

[Second Embodiment]

Next, a hair clip (hereinafter, referred to as "present hair clip") according to a second embodiment will be described with reference to FIGS. 6 through 10.

Figure 6:
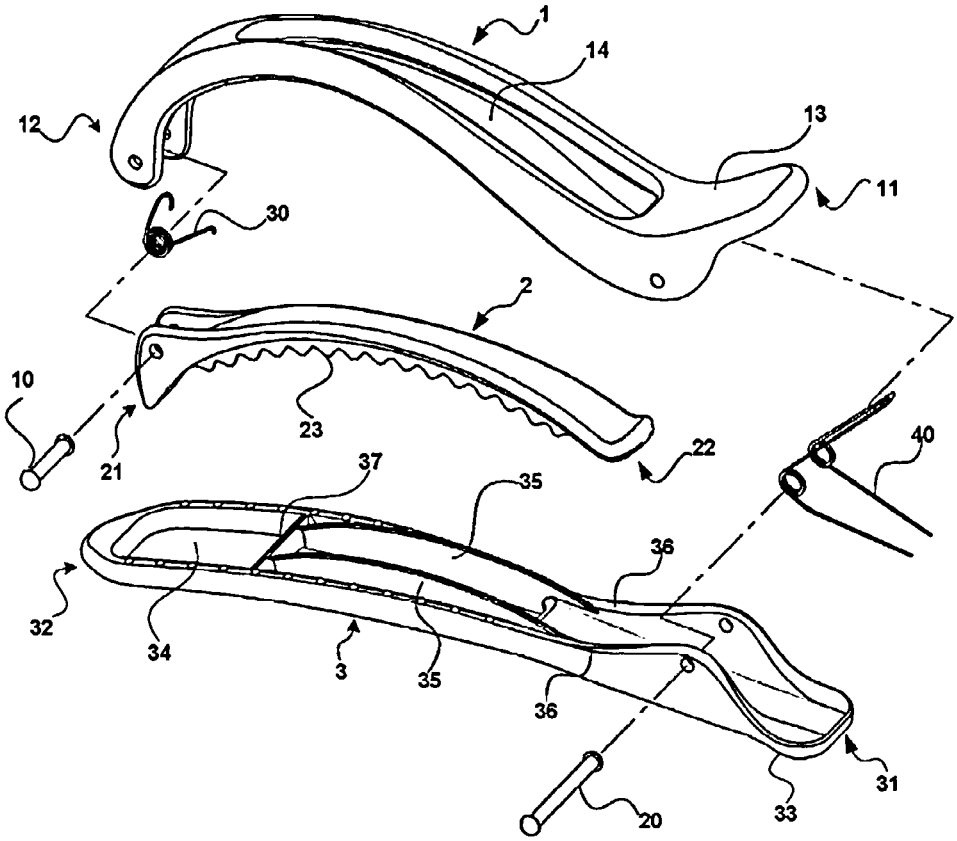
FIG. 6 is an exploded perspective view illustrating a main portion of a hair clip according to a second embodiment of the present invention.
Figure 7:
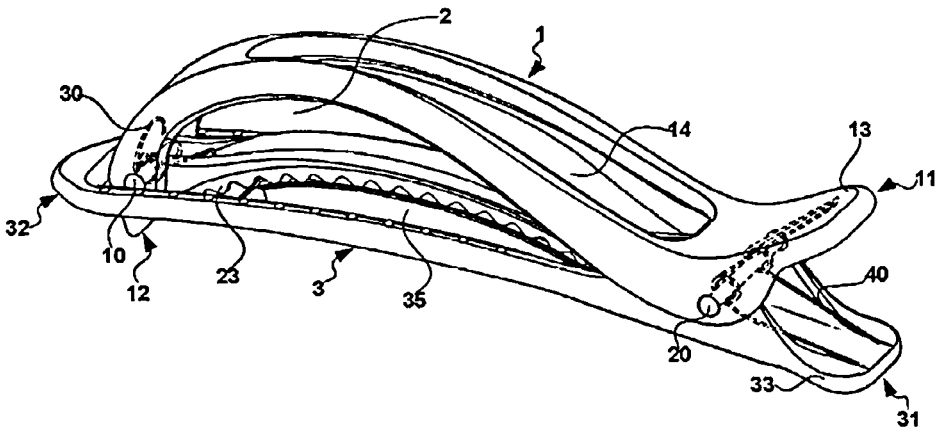
FIG. 7 is a diagram illustrating a state where the hair clip of FIG. 6 is not pressed.

FIG. 6 is an exploded perspective view illustrating a main portion of the present hair clip and FIG. 7 illustrates the hair clip of FIG. 6 not being pressed at all.

As illustrated in FIG. 6, the present hair clip includes an upper clip portion 1, a middle clip portion 2, and a lower clip portion 3.

A first end 11 of the upper clip portion 1 is provided with a first through hole 14 extending in a longitudinal direction, and a first pressed portion 13 which is pinched and pressed by user's fingers. Referring to FIG. 6, the upper clip portion 1 has a sectional shape of the letter "S". That is, the upper clip portion 1 has a curved shape to hold a large volume of hair.

Figure 10:
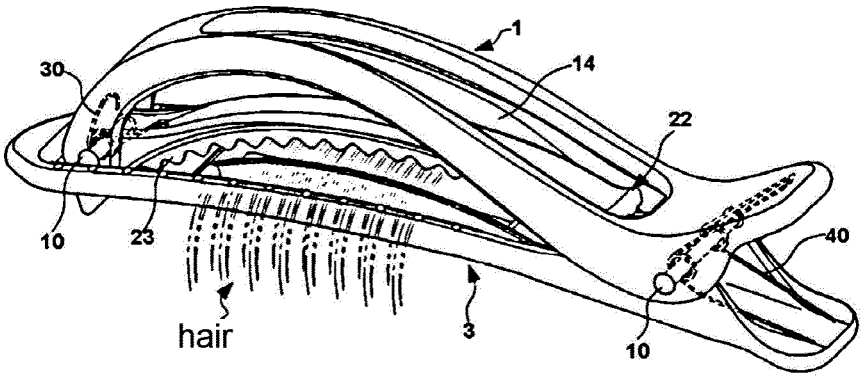
FIG. 10 is a diagram illustrating a state where the hair clip of FIG. 2 is pinching hair.
Figure 11:
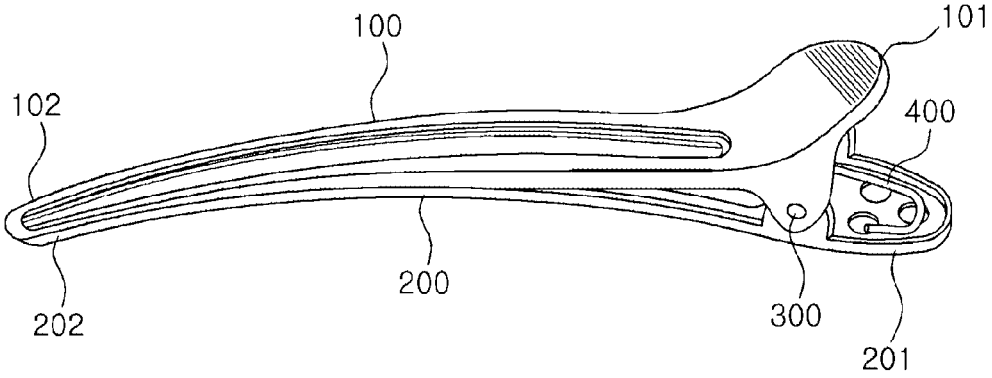
Fig. 11 PRIOR ART
FIG. 11 is a perspective view illustrating a conventional hair clip.
Figure 12:
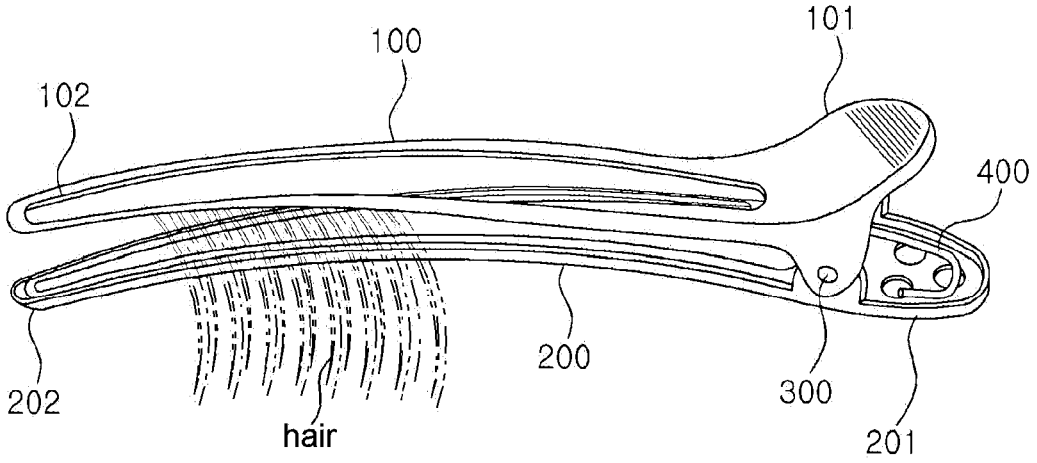
Fig. 12 PRIOR ART
FIG. 12 is a perspective view illustrating a state where the hair clip of FIG. 11 is pinching hair.

In the middle clip portion 2, a first end 21 is hinge-connected to a second end 12 of the upper clip portion 1. When the hair clip pinches hair, especially, a large volume of hair, a second end 22 passes through the first through hole 14 of the upper clip portion 1. Accordingly, a width of the second end 22 of the middle clip portion 2 is desirably smaller than a width of the first through hole 14 formed in the upper clip portion 1. With reference to FIG. 10, the second end 22 of the middle clip portion 2 is inserted in the first through hole 14 of the upper clip portion 1. The length of the second end portion 22 which is inserted in the first through hole 14 of the upper clip portion 1 varies depending on the volume of hair pinched by the hair clip.

The upper clip portion 1 and the middle clip portion 2 are hinge-connected to each other so that elastic force acts in a direction in which the upper clip portion 1 and the middle clip portion 2 separate from each other. Specifically, the hinge connection between the upper clip portion 1 and the middle clip portion 2 can be made by a hinge pin 10 which passes through the second end 12 of the upper clip portion 1 and the first end 21 of the middle clip portion 2, and a coil spring 30 which is installed to wind around the hinge pin 10 and applies elastic force in a direction in which the upper clip portion 1 and the middle clip portion 2 separate from each other.

Both side edges at a lower end of the middle clip portion are provided with a pair of toothed protrusions 23, respectively extending in a longitudinal direction and are parallel with each other. For reference, FIG. 6 illustrates only one toothed protrusion 23. That is, the other toothed protrusion 23 on the opposite side is not illustrated.

The lower clip portion 3 has a first end 31 which is provided with a second pressed portion 33 and which is hinge-connected to the first end 11 of the upper clip portion 1. The lower clip portion 3 supports the middle clip portion 2.

The upper clip portion 1 and the lower clip portion 3 are hinge-connected to each other so that elastic force acts in a direction in which the upper clip portion 1 and the lower clip portion 3 approach each other, i.e., a direction in which a leading end A of the hair clip closes. For example, the hinge connection between the upper clip portion 1 and the lower clip portion 3 is made using a hinge pin 20 which passes through the first end 11 of the upper clip portion 1 and the first end 31 of the lower clip portion 3, and a coil spring 40 which is installed to wind around the hinge pin 20 and applies elastic force in a direction in which the upper clip portion 1 and the lower clip portion approach each other.

The lower clip portion 3 has a second through hole 34 through which the first end 21 of the middle clip portion 2 passes when the hair clip pinches hair. According to the volume of hair which is pinched, either or both of the first end 21 of the middle clip portion 2 and the second end 12 of the upper clip portion 1 is inserted into the second through hole 34.

In order to support the middle clip portion 2, the lower clip portion 3 may have a support sill 37 near the second through hole 34.

A pair of rails 35 arranged in parallel with each other may be formed on the upper surface of the lower clip portion 3. An interval between the pair of rails 35 is determined such that the hair can be firmly pinched when the toothed protrusions 23 of the middle clip portion 2 are disposed between the pair of rails 35.

The second end 22 of the lower clip portion 3 is a free end. When a user presses the hair clip such that the first pressed portion 13 and the second pressed portion 33 approach each other, the second end 22 of the middle clip portion 2 slides toward the leading end A of the hair clip while the second end 22 of the middle clip portion 2 is in contact with the upper surface of the lower clip portion 3. Accordingly, it is possible to prevent hair from entering into the hinge mechanism which connects the upper clip portion 1 and the lower clip portion 3. In order to help the second end 22 of the middle clip portion 2 to slide, a guide wall 36 for guiding the second end 22 of the middle clip portion 2 is formed on the upper surface of the middle clip portion 3.

Next, operation of the hair clip according to the second embodiment having the above-described structure is described.

Figure 8:
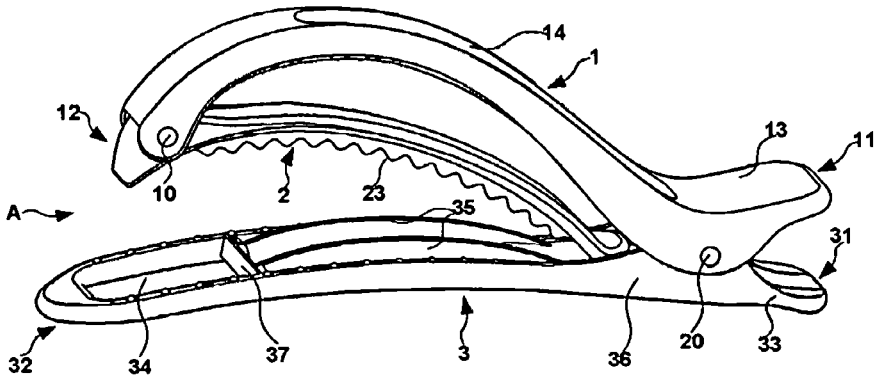
FIG. 8 is a diagram illustrating a state where the hair clip of FIG. 6 is weakly pressed.
Figure 9:
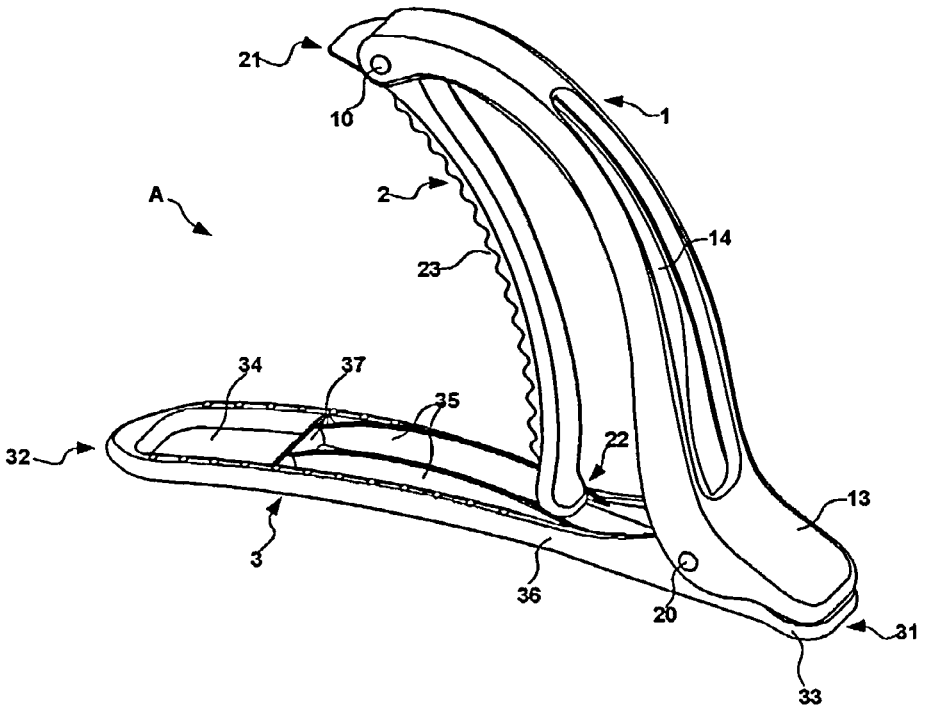
FIG. 9 is a diagram illustrating a state where the hair clip of FIG. 6 is fully pressed.

For reference, FIG. 8 illustrates the hair clip weekly pressed, FIG. 9 illustrates the hair clip fully pressed, and FIG. 10 illustrates the hair clip which is pinching hair after pressing force to the hair clip is removed.

In order to pinch hair with the hair clip, as illustrated in FIGS. 8 and 9, the user presses the first pressed portion 13 of the upper clip portion 1 and the second pressed portion 33 of the lower clip portion 3 so that the leading end A will open to a necessary extent.

At this time, the middle clip portion 2 also moves so that the middle clip portion 2 separates from the upper clip portion 1, and the second end 22 of the middle clip portion 2 slides toward the leading end A of the hair clip while the second end 22 is being in contact with the upper surface of the lower clip portion 3. This operation prevents hair from coming into contact with and entering into the hinge mechanism which connects the upper clip portion 1 and the lower clip portion 3.

When pressing force applied to the first pressed portion 13 of the upper clip portion 1 and the second pressed portion 33 of the lower clip portion 3 is removed in a state where a predetermined volume of hair is inserted between the middle clip portion 2 and the lower clip portion 3, hair is pinched between the middle clip portion 2 and the lower clip portion 3.

At this time, as illustrated in FIG. 10, the first end 21 of the middle clip portion 2 is inserted into the second through hole 34 of the lower clip portion 3, so the hair does not escape out of the hair clip and is more firmly pinched.

Whether the second end 22 of the middle clip portion 2 can pass through the first through hole 14 of the upper clip portion 1 is determined according to the volume of hair which is pinched. Furthermore, since the middle clip portion 2 is hinge-connected to the upper clip portion 1 and elastic force exerts in a direction in which the middle clip portion 2 and the upper clip portion 1 separate from each other, it possible for hair to be effectively pinched by the hair clip. In addition, hair is more firmly pinched due to a mutual action of the second toothed protrusions 23 of the middle clip portion 2 and the rails 35 of the lower clip portion 3.

As described above, the hair clip according to the second invention can pinch a large volume of hair at a time, and can firmly pinch the hair so that the hair cannot slip out of or escape from the hair clip thanks to the hinge mechanism which connects the upper clip portion and the middle clip portion and the hinge mechanism which connects the upper clip portion and the lower clip portion.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A hair clip comprising:

an upper clip portion having a first end provided with a first pressed portion;

a middle clip portion having a first end connected to a second end of the upper clip portion in a hinged manner; and a lower clip portion having a first end connected to the first end of the upper clip portion in a hinged manner and a second end disposed opposite to the first end, the first end being provided with a second pressed portion which is pressed together with the first pressed portion, and supporting the middle clip portion, wherein the upper and middle clip portions are connected in a hinged manner so that elastic force is applied in a direction in which the upper and middle clip portions move apart from each other, wherein the upper and lower clip portions are connected in a hinged manner so that elastic force is applied in a direction in which the upper and lower clip portions approach each other, wherein the upper clip portion is provided with a first toothed portion having teeth protruding toward the lower clip portion, and wherein, when pressing force is applied to the hair clip in a direction in which the first pressed portion and the second pressed portion approach each other, a second end of the middle clip portion slides on an upper surface of the lower clip portion in a direction toward the second end of the lower clip portion while maintaining to come in contact with the upper surface of the lower clip portion.

2. The hair clip according to claim 1, wherein the first toothed portion is formed between a hinged portion and a middle portion of the upper clip portion in a longitudinal direction.

3. The hair clip according to claim 1, wherein the middle clip portion is provided with a second toothed portion having saw teeth protruding toward the lower clip portion.

4. The hair clip according to claim 3, wherein a length of teeth of the second toothed portion is increased as the teeth get closer to the first end of the middle clip portion in the longitudinal direction.

5. The hair clip according to claim 1, wherein a width of the lower clip portion is decreased as a distance to the second end of the lower clip portion is decreased.

6. The hair clip according to claim 5, wherein the first end of the middle clip portion is provided with an accommodation recess in which the second end of the lower clip portion is accommodated when the hair clip holds hair.

* * * * *